US006890252B2

(12) United States Patent
Liu

(10) Patent No.: US 6,890,252 B2
(45) Date of Patent: May 10, 2005

(54) FUME HOOD EXHAUST STACK SYSTEM

(76) Inventor: Mingsheng Liu, 17569 "Y" St., Omaha, NE (US) 68135

( * ) Notice: Subject to any disclaimer, the term of this patent is extended or adjusted under 35 U.S.C. 154(b) by 213 days.

(21) Appl. No.: 10/275,059

(22) PCT Filed: May 1, 2001

(86) PCT No.: PCT/US01/14046

§ 371 (c)(1),
(2), (4) Date: Mar. 10, 2003

(87) PCT Pub. No.: WO01/83125

PCT Pub. Date: Nov. 8, 2001

(65) Prior Publication Data

US 2003/0207662 A1 Nov. 6, 2003

Related U.S. Application Data

(60) Provisional application No. 60/201,226, filed on May 1, 2000.

(51) Int. Cl.[7] ..... B08B 15/02
(52) U.S. Cl. ..... 454/61; 454/27
(58) Field of Search ..... 454/1, 3, 27, 30, 454/31, 61, 62

(56) References Cited

U.S. PATENT DOCUMENTS

| | | | | |
|---|---|---|---|---|
| 4,203,485 | A | | 5/1980 | Zilbermann et al. |
| 4,377,969 | A | | 3/1983 | Nelson |
| 4,513,574 | A | | 4/1985 | Humphreys et al. |
| 4,519,217 | A | | 5/1985 | Phillips et al. |
| 4,706,553 | A | | 11/1987 | Sharp et al. |
| 4,775,001 | A | | 10/1988 | Ward et al. |
| 4,915,294 | A | | 4/1990 | Wylie |
| 5,031,515 | A | | 7/1991 | Niemelä et al. |
| 5,080,282 | A | | 1/1992 | Harmon |
| 5,103,896 | A | | 4/1992 | Saga |
| 5,297,954 | A | | 3/1994 | Colagiovanni |
| 5,538,471 | A | | 7/1996 | Guiles, Jr. |
| 5,597,354 | A | | 1/1997 | Janu et al. |
| 5,632,675 | A | | 5/1997 | Kanninen et al. |
| 5,643,077 | A | | 7/1997 | Ayer |
| 5,697,838 | A | * | 12/1997 | Morris ..... 454/62 |
| 5,707,005 | A | | 1/1998 | Kettler et al. |
| 5,724,701 | A | | 3/1998 | Jones |
| 5,810,657 | A | | 9/1998 | Pariseau |
| 5,873,257 | A | | 2/1999 | Peterson |
| 5,881,806 | A | | 3/1999 | Rudd |
| 5,907,956 | A | | 6/1999 | Arima et al. |
| 5,916,252 | A | | 6/1999 | Yoshida et al. |
| 5,927,599 | A | | 7/1999 | Kath |
| 5,945,924 | A | | 8/1999 | Marman et al. |
| 5,966,773 | A | | 10/1999 | Jones |
| 5,976,010 | A | | 11/1999 | Reese et al. |
| 5,979,167 | A | | 11/1999 | Kochavi et al. |
| 5,983,890 | A | | 11/1999 | Thomas et al. |
| 5,991,394 | A | | 11/1999 | Dezonno et al. |
| 6,006,142 | A | | 12/1999 | Seem et al. |
| 6,006,528 | A | | 12/1999 | Arima et al. |
| 6,008,733 | A | | 12/1999 | Okano et al. |
| 6,009,939 | A | | 1/2000 | Nakanishi et al. |
| 6,071,188 | A | | 6/2000 | O'Neill et al. |

* cited by examiner

*Primary Examiner*—Harold Joyce
(74) *Attorney, Agent, or Firm*—Shook, Hardy & Bacon LLP

(57) ABSTRACT

A fume hood exhaust stack system (10) and method utilize a variable speed fan (24) and an exhaust stack (28) having an adjustable cross-sectional area. Toxic exhaust from one or more fume hoods (12) is conveyed through a header (16) to the fan. The fan forces the exhaust through the exhaust stack, and the exhaust is then discharged into the atmosphere at a sufficient velocity and momentum to ensure that the exhaust reaches an environmentally sound altitude. A variable speed drive (36), programmable controller (34), flow signals (26), and static pressure and total pressure signals (20) are utilized to modulate the speed of the fan and the area of the exhaust stack to maintain the desired fan inlet pressure and exhaust velocity.

14 Claims, 3 Drawing Sheets

FUME HOOD EXHAUST STACK SYSTEM

CROSS-REFERENCE TO RELATED APPLICATIONS

This patent application is a nonprovisional application claiming priority from U.S. provisional application No. 60/201,226, filed in the United States Patent and Trademark Office on or about May 1, 2000.

STATEMENT REGARDING FEDERALLY SPONSORED RESEARCH OR DEVELOPMENT

Not applicable.

BACKGROUND OF THE INVENTION

This invention relates generally to exhaust systems and methods, and more particularly to an energy efficient and environmentally sound advanced stack system and method for exhausting toxic air from fume hoods.

Laboratories and other facilities typically contain fume hoods in which chemical processes produce toxic fumes. These facilities necessarily contain fume exhaust stack systems that exhaust this toxic air from the building and send the toxic air through a stack to a prescribed minimum altitude such that fresh air contamination and environmental pollution is reduced. To satisfy environmental safety standards, the fume exhaust stack system must provide a minimum velocity and momentum to the toxic exhaust exiting the stack to ensure that the toxic exhaust reaches a minimum altitude substantially higher than the outlet of the stack. Due to architecture, structural, and economic limitations, however, the stack is often required to be as short as possible.

A typical fume hood exhaust stack system (depicted in FIG. 1) consists of a stack, a constant-speed fan, a make-up air damper, fume hoods, a static pressure sensor, and a controller. In these conventional fume exhaust stack systems, the total toxic air flow rate and volume from the fume hoods are significantly below the optimal design values because the majority of the fume hoods are typically in a standby mode in which they exhaust little or no toxic air into the exhaust header. These system utilize a controller that modulates a make-up air damper to maintain a static pressure set point at the exhaust header. When the toxic air flow rate decreases to a value less than the design value, the controller opens the make-up air damper to maintain the desired static pressure set point; conversely, when the toxic air flow rate increases, the controller closes the make-up air damper to maintain the set point. Since the static pressure sensor is often located far from the mixing junction of the make-up air conduit and exhaust header discharge conduit, the static pressure at the inlet of the fan is significantly higher under partial exhaust air flow conditions than under full exhaust air flow conditions.

Under partial exhaust conditions—when the make-up air damper is open or partially open—the air flow rate through the fan is higher than the design value due to the higher static pressure at the inlet of the fan. The fan power consumption under these partial-exhaust high static pressure conditions is often up to 30% greater than the fan power consumed under full exhaust conditions; fan power consumption increases as exhaust air flow rate decreases. Fan power consumption increases as exhaust air flow decreases. The exhaust fans generally operate for 8,760 hours annually, while the fume hoods generally operate less than two hours per day. These existing systems therefore consume excess power and overload the fan motor when the exhausted toxic air flow from the fume hoods is less than the design value.

There is therefore a need for an energy efficient fume hood exhaust stack system and method that reduces fan power consumption while ensuring that the toxic exhaust discharged from the stack exits the stack with a relatively constant velocity and momentum sufficient to ensure that the toxic exhaust reaches an environmentally sound elevation.

SUMMARY OF THE INVENTION

Accordingly, it is an object of the present invention to provide an advanced fume exhaust stack system and method that consumes less power than conventional systems and methods.

It is also an object of the present invention to provide an advanced fume exhaust stack system and method that ensures that toxic exhaust discharged from the stack has a relatively constant velocity and momentum sufficient to ensure that the toxic exhaust reaches an environmentally sound elevation.

It is a further object of the present invention to provide an advanced fume exhaust stack system utilizing a variable-speed motor driven fan and an adjustable area stack outlet.

It is also an object of the present invention to utilize a programmable controller and variable speed drive to maintain the exhaust pressure at the inlet of the fan at a relatively constant desired level.

It is another object of the present invention to provide an advanced fume exhaust stack system that utilizes a programmable controller to modulate the outlet area of the exhaust stack to substantially maintain the total pressure at a constant total pressure set point, thereby ensuring that the toxic exhaust discharged from the stack has a relatively constant velocity and momentum sufficient to ensure that the toxic exhaust reaches an environmentally sound elevation.

It is yet another object of the present invention to provide an advanced fume exhaust stack system that utilizes a programmable controller to modulate the outlet area of the exhaust stack to substantially maintain the exhaust flow rate at a constant-design flow rate, thereby ensuring that the toxic exhaust discharged from the stack has a relatively constant velocity and momentum sufficient to ensure that the toxic exhaust reaches an environmentally sound elevation.

Accordingly, the present invention provides for an energy efficient and environmentally sound advanced fume hood exhaust stack system and method that maintains a relatively constant static pressure at the inlet of the fan and Maintains a relatively constant desired velocity and momentum of the exhaust by modulating the diameter of the exhaust stack outlet. The system and method utilize a stack with an adjustable outlet, a fan, a variable speed drive, a flow sensor or total pressure sensor, a static pressure sensor, and a controller. No make-up air is utilized. The variable speed drive receives signals from the controller and modulates the fan speed to maintain a desired static pressure set point. When the measured static pressure is less than the static pressure set point, the variable speed drive reduces the speed of the fan to increase the static pressure to the set point. When the measured static pressure is greater than the static pressure set point, the variable speed drive increases the speed of the fan to reduce the static pressure to the set point. The advanced stack system is generally controlled and operated in three modes to maintain an exhaust flow from the stack having a desired constant velocity and momentum; the controller may be programmed with a variety of algorithms, equations, and set points, including static pressure set points, total pressure set points, stack outlet diameter set points, and exhaust flow rate set points.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION OF THE PREFERRED EMBODIMENTS

Figure 1:
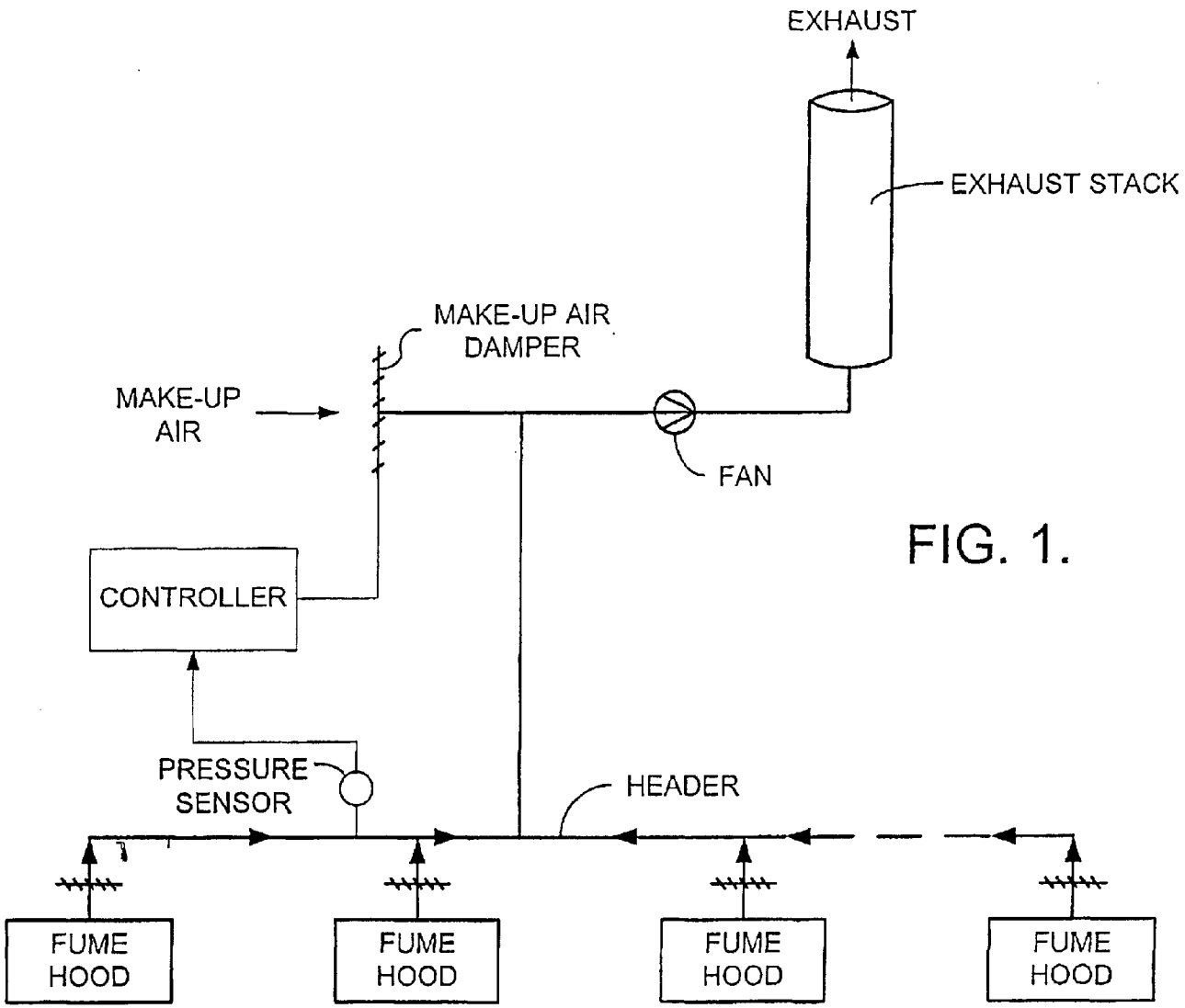
FIG. 1 is a schematic of a conventional fume exhaust stack system having a constant speed fan, make-up air damper, and fixed area stack.
Figure 2:
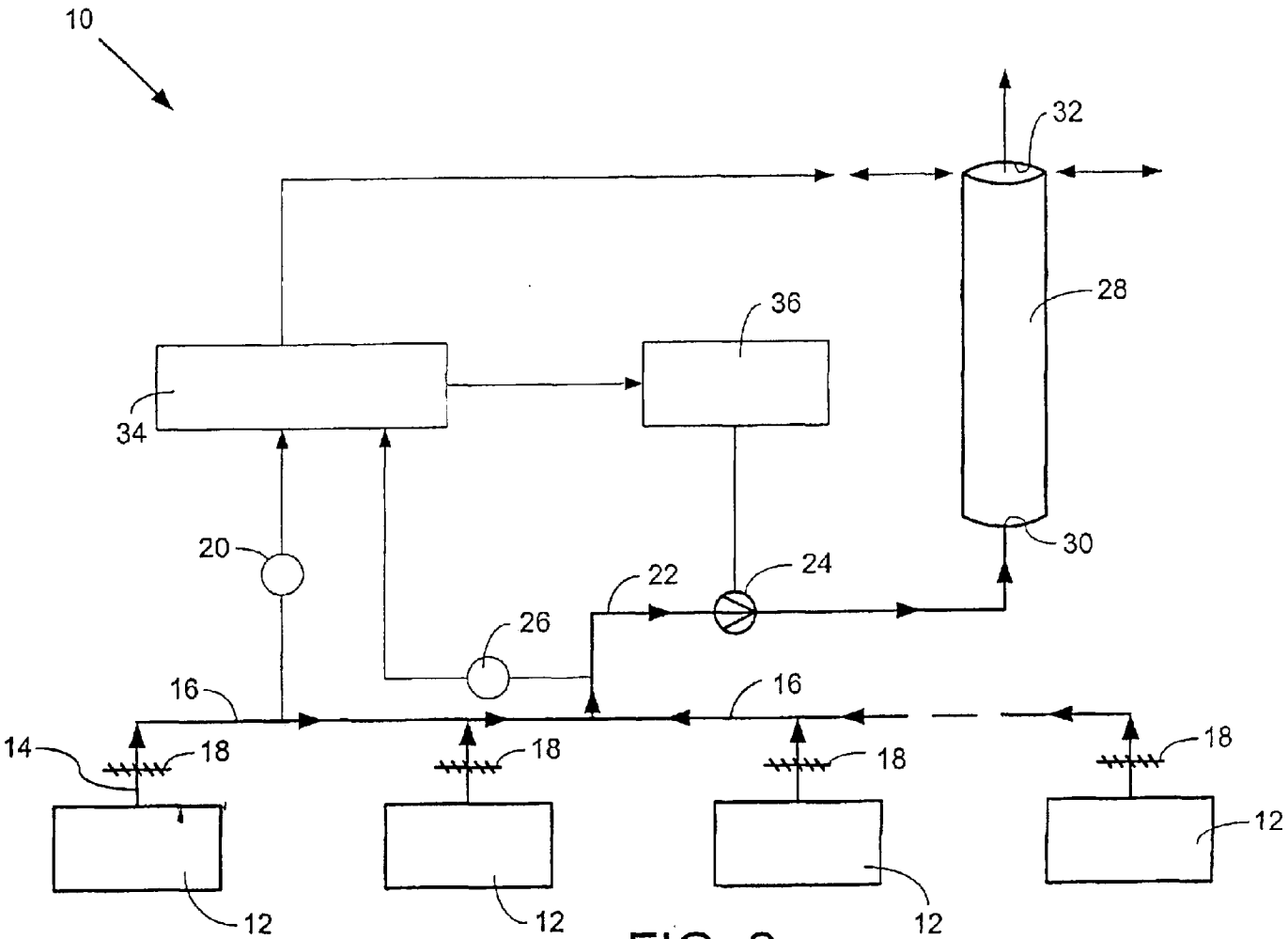
FIG. 2 is a schematic of an advanced fume exhaust stack system having a flow sensor and a controller which modulates the outlet area of the stack based on the measured exhaust air flow.

Referring to the drawings in greater detail, and initially to FIG. 2, an advanced fume hood exhaust stack system is designated generally by the numeral 10. One or more fume hoods 12 collect and discharge toxic exhaust through individual fume hood exhaust conduits 14 and into a common exhaust header 16. Individual fume hood exhaust dampers 18 may be positioned in the individual fume hood exhaust conduits 14, as depicted in FIG. 2, to enable a particular fume hood 12 to be isolated from the system.

A static pressure sensor and transmitter 20 is located at exhaust header 16 and measures the static pressure of the exhaust within the header 16. The pressure sensor and transmitter 20 is adapted to transmit a signal proportional to the static pressure of the exhaust within the header 16. The proportional transmitter signal may be a pulse signal, a 4–20 mA signal, or other electrical or digital signal commonly employed by and well known to those skilled in the art.

A header discharge conduit 22 conveys exhaust from the header 16 to the inlet of a fan 24. The fan 24 is generally motor driven. As seen in FIG. 2, a flow sensor and transmitter 26 is located at header discharge conduit 22, upstream of the fan 24, and measures the flow rate of the exhaust flowing from the header 16 to the inlet of the fan 24. The flow sensor and transmitter 26 is adapted to transmit a signal proportional to the flow rate of the exhaust flowing from the header 16 to the inlet of the fan 24. The proportional transmitter signal may be a pulse signal, a 4–20 mA signal, or other electrical or digital signal commonly employed by and well known to those skilled in the art.

Exhaust is conveyed from the exhaust header 16, through the header discharge conduit 22 and motor-driven fan 24, into and through exhaust stack 28, and into the atmosphere. Exhaust stack 28 has an inlet 30 and an outlet 32. The outlet 32 of exhaust stack 28 has an adjustable area; the area may be increased or decreased by varying the diameter of the outlet 32 or otherwise modulating the area through which exhaust exits the stack 28 and is ejected into the atmosphere. The area of outlet 32 is modulated by a controller 34. The controller 34 is typically a programmable logic controller (PLC) or other programmable controller of the type commonly used by and well known to those skilled in the art. The controller 34 receives and processes a signal from the static pressure sensor and transmitter 20 proportional to the static pressure of the header 16. The controller 34 also receives and processes a signal from the flow sensor and transmitter 26 proportional to the rate of exhaust flow from the header 16 to the fan 24. The controller may be programmed with a variety of desired set points, including various static pressure set points, total pressure set points, stack outlet diameter set points, and design exhaust flow rates. The controller 34 is adapted to transmit a signal to variable speed drive 36 which, in turn, is adapted to transmit a signal to the electric motor of motor-driven fan 24 to modulate the speed of fan 24. It will be understood that variable speed drive 36 may be a variable frequency drive or other electrical or electromechanical drive (e.g. an eddy current drive or viscous drive) commonly used and well known to those skilled in the art.

In operation, and in the configuration depicted in FIG. 2 and described above, the controller 34 is programmed with a desired static pressure set point, a design flow rate, and a maximum design diameter of stack outlet 32 for the design flow rate. The controller modulates the diameter of outlet 32 based on the flow rate measured by flow sensor and transmitter 26. The set point of the diameter of outlet 32 is calculated from the following equation and is based on the measured flow rate:

$$D=D_o(Q/Q_o)$$

Where $Q_o$ is the design flow rate, Q is the flow rate measured by flow sensor and transmitter 26, and $D_o$ is the maximum design diameter of outlet 32.

As the variable speed drive 36 increases the speed of fan 24, the flow rate of exhaust from header 16 to stack 28 increases and the static pressure at header 16 and the inlet of fan 24 decreases toward a desired static pressure set point. As the variable speed drive 36 decreases the speed of fan 24, the flow rate of exhaust from header 16 to stack 28 decreases and the static pressure at header 16 increases toward the desired static pressure set point. In this manner, the static pressure at header 16 is substantially maintained at the programmed static pressure set point.

To maintain a relatively constant desired exhaust velocity and momentum at the outlet 32 of stack, the diameter of stack outlet 32 is modulated by the controller 34 in accordance with the above programmed equation. If the measured flow rate Q exceeds the design flow rate $Q_o$, the controller 34 reduces the diameter D of stack outlet 32, thereby reducing the flow rate Q measured by flow sensor and transmitter 26. If the measured flow rate Q is less than the design flow rate $Q_o$, the controller 34 increases the diameter D of stack outlet 32, thereby increasing the flow rate Q measured by flow sensor and transmitter 26. In this manner, the flow rate Q is continually modulated toward the programmed design flow rate $Q_o$ to provide a relatively constant and sufficient exhaust velocity and momentum as the exhaust exits the stack 28 through outlet 32.

Figure 3:
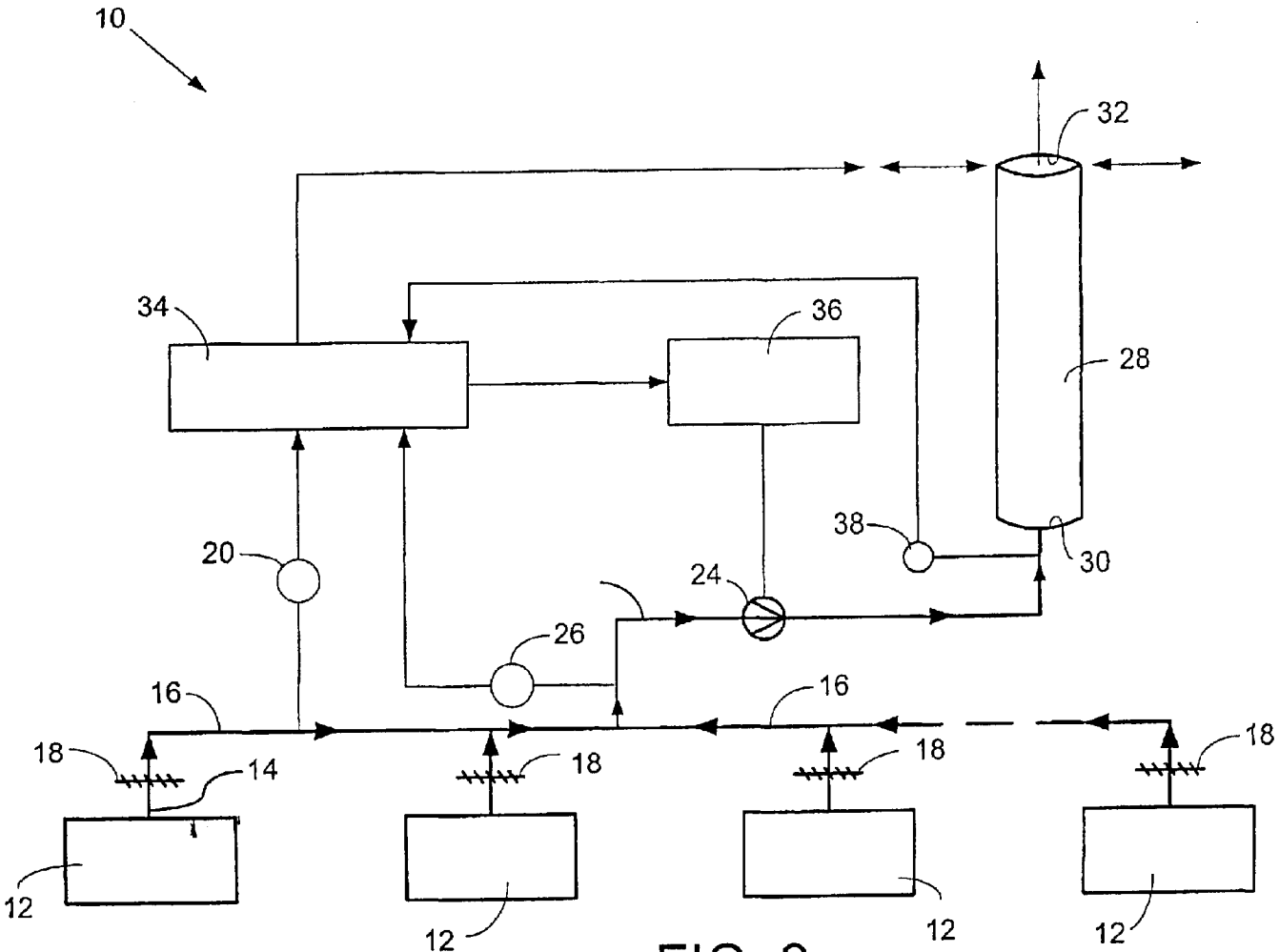
FIG. 3 is a schematic of an advanced fume exhaust stack system having a total pressure sensor, flow sensor, and a controller which modulates the outlet area of the stack to maintain a total pressure set point.

Referring now to FIG. 3, another embodiment of the advanced fume hood exhaust stack system 10 is depicted. In this configuration, as in the configuration depicted in FIG. 2, one or more fume hoods 12 discharge exhaust through conduits 14 and into an exhaust header 16. Individual fume hood exhaust dampers 18 may be used to isolate a particular fume hood 12 from the system. Exhaust from header 16 flows through header discharge conduit 22, through motor-driven fan 24, and through exhaust stack 28. Stack 28 has an inlet 30 and an adjustable area outlet 32. The area of outlet 32 is modulated increased or decreased—by a programmable controller 34.

Again referring to FIG. 3, a static pressure sensor and transmitter 20 measures the static pressure at the header 16 and transmits a signal proportional to the static pressure of the exhaust within the header 16 to the programmable controller 34. A header discharge conduit 22 conveys exhaust from the header 16 to the inlet of the motor-driven fan 24. A flow sensor and transmitter 26 is located at header discharge conduit 22, upstream of the fan 24, and measures the flow rate of the exhaust flowing from the header 16 to the inlet of the fan 24. The flow sensor and transmitter 26 is adapted to transmit to the controller 34 a signal proportional to the flow rate of the exhaust flowing from the header 16 to the inlet of the fan 24. In addition to the static pressure sensor and transmitter 20 and the flow sensor and transmitter 26, the system depicted in FIG. 3 includes a total pressure sensor and transmitter 38. Total pressure sensor and transmitter 38 measure the total pressure of the exhaust within header discharge conduit 22 downstream of fan 24 and upstream of exhaust stack 28, as seen in FIG. 3, and transmits a signal proportional to the total pressure to the controller 34. The proportional pressure signal, flow rate signal, and total pressure signal transmitted to the controller 34 may be pulse signals, 4–20 mA signals, or other electrical or digital signals commonly employed by and well known to those skilled in the art. The controller is adapted to transmit a signal to the variable speed drive 36 which, in turn, is adapted to transmit a signal to the electric motor of motor-driven fan 24 to modulate the speed of fan 24.

In one mode of operation, the system depicted in FIG. 3 utilizes the programmable controller 34 to modulate a total pressure set point based upon the diameter of the outlet 32 of exhaust stack 28. In this mode of operation, the controller requires signals from the static pressure sensor and transmitter 20 and the total pressure sensor and transmitter 38; input from the flow sensor and transmitter 26 is not required. The set point of the total pressure is determined by the following equations:

$$P_{set} = P_0 \frac{\left(\frac{D_0}{D}\right)^2 \left[1 + f_0 \frac{L}{D_0} \frac{D_0}{D} + k_e \left(\frac{D}{D_0}\right)^2\right]}{1 + f_0 \frac{L}{D_0}}$$

$$P_0 = \left(1 + f_0 \frac{L}{D_0}\right) \frac{V_0^2}{2g} \rho$$

$$f_o = f(x_0)$$

$$x_0 = \epsilon / D_0$$

$$f = f(x)$$

$$x = \epsilon / D$$

$$f(x) = -53129x^4 + 6033.6x^3 - 233.99x^2 + 4.434x + 0.013$$

$$k_e = 0.9598\left(\frac{D}{D_0}\right)^4 - 1.9541\left(\frac{D}{D_0}\right)^2 + 0.9818$$

Where L is the length of the exhaust stack 28, $D_0$ is the maximum diameter of the adjustable stack outlet 32, $V_0$ is the design velocity of the exhaust at the outlet 32, and $\epsilon$ is the roughness of the inner surface of the stack 28.

In another mode of operation, the system depicted in FIG. 3 utilizes the programmable controller 34 to modulate the diameter of the outlet 32 of exhaust stack 28 to maintain a desired total pressure set point. The total pressure set point is determined based upon the above equations. In this mode of operation, the controller 34 requires signals from the static pressure sensor and transmitter 20, the total pressure sensor and transmitter 36, and the flow sensor and transmitter 26.

In operation, the controller 34 is programmed with a desired static pressure set point, a design flow rate, and a maximum design diameter of stack outlet 32. To maintain the static pressure at header 16 at a substantially constant programmed set point, the controller 34 and variable speed drive 36 modulate the speed of motor-driven fan 34. To decrease the static pressure at header 16 to a desired static pressure set point, variable speed drive 36 increases the speed of the fan 24 to increase the flow rate of the exhaust from header 16. To increase the static pressure to a desired static pressure set point, variable speed drive 36 decreases the speed of fan 24 to decrease the flow rate of the exhaust from header 16. In this manner, the speed of fan 24 is continually modulated to substantially maintain the static pressure at the desired programmed set point.

To maintain the velocity and momentum of the exhaust exiting stack outlet 32 at a substantially constant minimum level, the system depicted in FIG. 3 utilizes total pressure sensor and transmitter 38 to measure the total pressure at the inlet 30 of stack 28 and transmit to controller 34 a signal proportional to the measured total pressure. If the measured total pressure is less than the programmed total pressure set point, minus a dead band value, the diameter of the stack outlet 32 is decreased by controller 34 to satisfy the set point. If the measured total pressure is greater than the programmed total pressure set point, plus a dead band value, the diameter of the stack outlet 32 is increased by controller 34 to satisfy the set point. The total pressure set point is generally updated at programmed time intervals (e.g. every three minutes). In this way, the total pressure is maintained at a minimum desired value, and the velocity and momentum of the exhaust passing through stack 28 are maintained at desired substantially constant values to ensure that the exhaust reaches the desired altitude upon exiting stack outlet 32.

It will be seen from the foregoing that this invention is one well adapted to attain the ends and objects set forth above, and to attain other advantages which are obvious and inherent in the system and method. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter shown in the accompanying drawings or described hereinabove is to be interpreted as illustrative and not limiting.

I claim:

1. A fume exhaust stack system comprising:

one or more fume hoods adapted to emit exhaust into a header, said one or more fume hoods in fluid communication with said header;

an exhaust stack having a cross-sectional area, said area being adjustable;

a fan adapted to convey said exhaust from said header to said stack;

a variable speed drive adapted to modulate the speed of said fan; and a flow sensor adapted to measure the flow of said exhaust from said header to said stack and to transmit a flow input signal to a controller to direct the degree of modulation performed by the variable speed drive and the degree of exhaust stack cross-sectional area adjustment, said flow input signal proportional to said flow.

2. The fume exhaust stack system of claim 1, said stack formed with an inlet and an outlet, said outlet having an adjustable area.

3. The fume exhaust stack system of claim 1, further comprising a static pressure sensor adapted to measure the static pressure within said header and to transmit a static pressure input signal to a controller, said static pressure input signal proportional to said static pressure.

4. The fume exhaust stack system of claim 1, further comprising a total pressure sensor adapted to measure the total pressure of said exhaust at the inlet of said stack and to transmit a total pressure input signal to a controller, said total pressure input signal proportional to said total pressure.

5. The fume exhaust stack system of claim 1, further comprising a controller, said controller adapted to modulate said area.

6. The fume exhaust stack system of claim 5, said controller being a programmable logic controller adapted to receive and transmit a plurality of input and output signals.

7. The fume exhaust stack system of claim 5, whereby said controller modulates said area to maintain a desired exhaust velocity and momentum at the outlet of said stack.

8. The fume exhaust stack system of claim 3, whereby the speed of said fan is modulated to substantially maintain said static pressure at a relatively constant desired level.

9. The fume exhaust stack system of claim 1, said controller modulating said area based upon said flow.

10. The fume exhaust stack system of claim 4, said controller modulating said area based upon said total pressure.

11. A system for exhausting fumes through a stack comprising:

generating exhaust in one or more fume hoods;

passing said exhaust from said one or more fume hoods to a header, said header in fluid communication with said one or more fume hoods;

conveying said exhaust to a stack, said stack in fluid communication with said header, said exhaust being conveyed from said header to said stack by a variable speed fan, said stack having an adjustable cross-sectional area;

measuring the flow of said exhaust from said header to said stack and transmitting a flow input signal to a controller to direct (a) modulation of the speed of the fan to maintain the pressure of said exhaust in said header at a substantially constant desired level and (b) modulation of said area of said stack to maintain sufficient velocity and momentum of said exhaust, said flow input signal being proportional to said flow; and ejecting said exhaust through said stack into the atmosphere.

12. The system of claim 11, further comprising the steps of measuring the total pressure at the inlet of said stack and transmitting a total pressure input signal to a controller, said total pressure input signal being proportional to said total pressure.

13. The system of claim 11, further comprising the step of modulating the speed of said fan, whereby the pressure of said exhaust in said header is maintained at a substantially constant desired level.

14. The system of claim 13, further comprising the steps of measuring the static pressure of said exhaust at said header and transmitting a static pressure input signal to a controller, said static pressure input signal being proportional to said static pressure.

* * * * *